US006175297B1

(12) United States Patent
Scollo

(10) Patent No.: US 6,175,297 B1
(45) Date of Patent: Jan. 16, 2001

(54) METHOD AND CIRCUIT FOR EMULATING A TRUMPET CONTACT BREAKER

(75) Inventor: Rosario Scollo, Misterbianco (IT)

(73) Assignee: STMicroelectronics S.r.l., Agrate Brianza (IT)

( * ) Notice: Under 35 U.S.C. 154(b), the term of this patent shall be extended for 0 days.

(21) Appl. No.: 09/093,578

(22) Filed: Jun. 8, 1998

(30) Foreign Application Priority Data

Jun. 9, 1997 (EP) ..... 97830275

(51) Int. Cl.[7] ..... G08B 3/10

(52) U.S. Cl. ..... 340/384.7; 340/389.73; 340/388.1; 340/576

(58) Field of Search ..... 340/384.7, 384.1, 340/388.1, 392.1, 384.73, 463, 576, 438; 307/10.1, 117

(56) References Cited

U.S. PATENT DOCUMENTS 3,665,391 * 5/1972 Bumpous ..... 340/479
3,824,538 * 7/1974 Slemp ..... 180/272
4,530,056 * 7/1985 MacKinnon et al. ..... 701/25
4,871,991 10/1989 Noda et al. ..... 340/384
5,032,994 * 7/1991 Wellman ..... 701/23
5,049,853 9/1991 Yoon ..... 340/388
5,109,212 4/1992 Cortinovis et al. ..... 340/384 E
5,293,149 3/1994 Wilson et al. ..... 340/384.73
5,457,437 10/1995 Kim ..... 340/384.1
5,934,704 * 8/1999 Hansen et al. ..... 280/735

* cited by examiner

*Primary Examiner*—Brent A. Swarthout
*Assistant Examiner*—Davetta W. Goins
(74) *Attorney, Agent, or Firm*—Theodore E. Galanthay; Robert Iannucci; SEED IP Law Group PLLC

(57) ABSTRACT

A method and circuit for emulating a contact breaker in trumpets having an inductor coil powered from a battery through a power driver device. The method includes obtaining the derivative of the current value flowing through the inductor of the trumpet coil, sensing a change in the slope of this derivative, and turning off a circuit portion of the driver device upon a negative slope being sensed. The circuit portion is turned back on with a transient of predetermined duration.

20 Claims, 2 Drawing Sheets

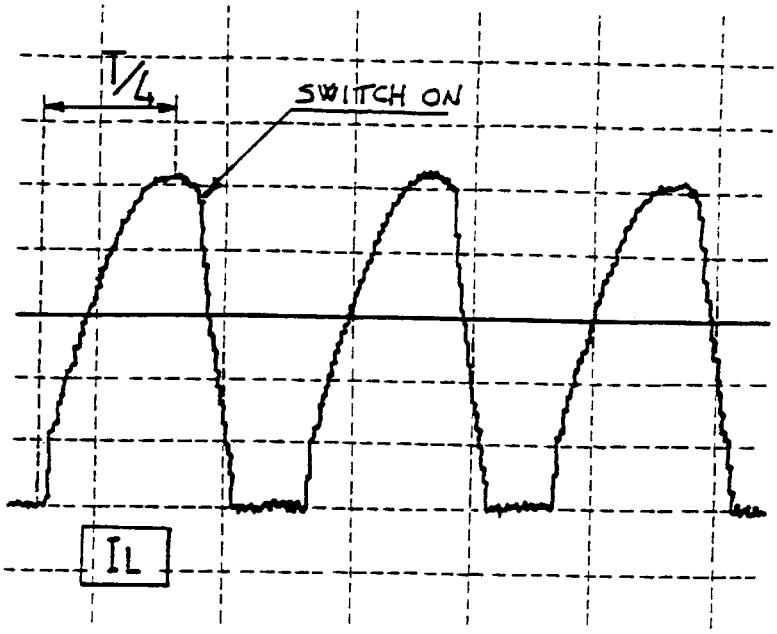
PRIOR ART FIG.1
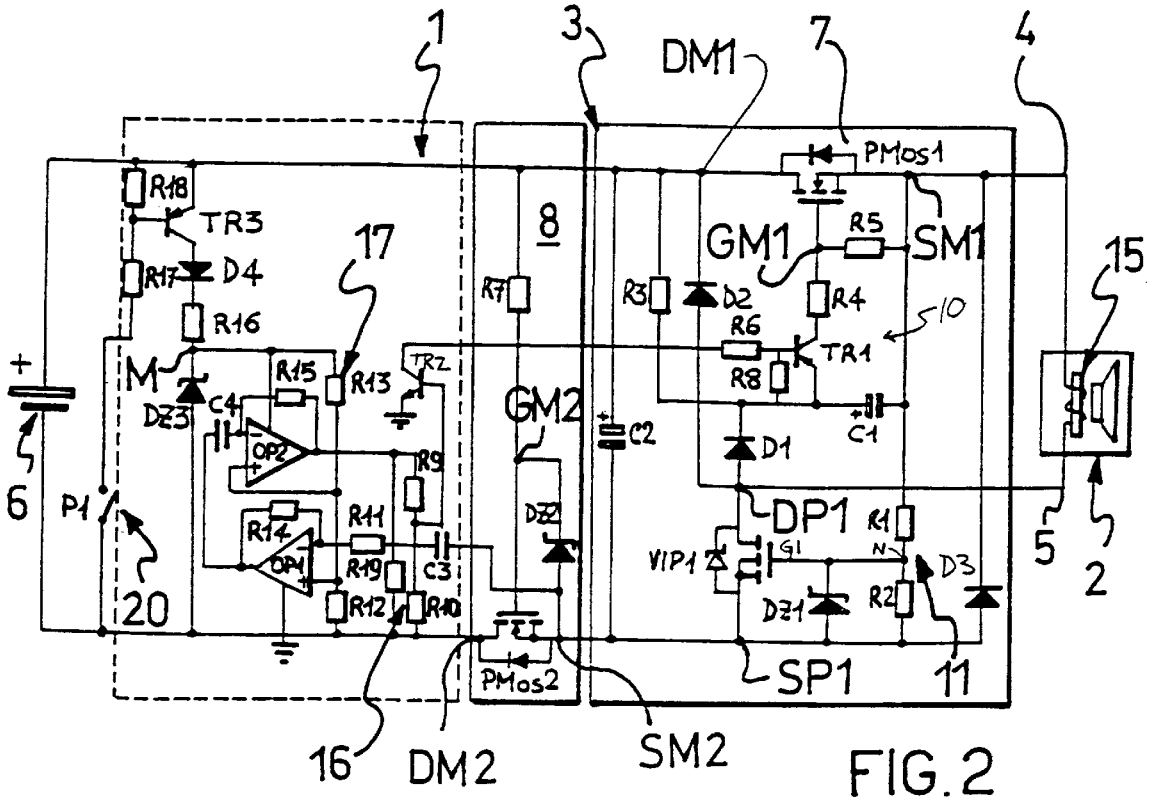
FIG.2

METHOD AND CIRCUIT FOR EMULATING A TRUMPET CONTACT BREAKER

TECHNICAL FIELD

The present invention relates to a method and an electronic circuit for emulating a contact breaker in trumpets comprising an inductor coil energized from a battery via a power driver device.

BACKGROUND OF THE INVENTION

As is well known, most trumpets of conventional design and construction are implemented with a simple series connection between a coil and a contact breaker within the trumpet itself. The contact breaker is controlled from the coil through a power supply battery. The contact breaker forms, together with the coil connected in series therewith, an electromechanically related system setting the resonance frequency of the trumpet. There exists a growing demand for breakerless trumpets. To fill this demand, it could be assumed of using systems incorporating fixed frequency oscillators, but their application to trumpets entails significant risk and disadvantages, as specified here below:

- a factory-applied frequency trimming step is required for each trumpet;
- the system may fail to operate as the supply voltage or the operating temperature changes, due to the oscillator frequency spreading from the electromechanical resonance frequency.

As an alternative, the prior art proposes solutions based on the use of power changeover or electronic switches. While being advantageous in several ways, not even this solution is entirely devoid of drawbacks, originating from the large amount of electric power to dissipate through the driver circuit. In fact, the inductive energy will discharge itself through the power switch, and the latter has to be provided with a large-size current sink and a voltage clamping device. This prior scheme requires in any case that a sink element be provided in the form of the power switch coupled to a large-size sink. In addition, with the breaker replaced by electronic power devices, the system performance can no longer be maintained, since a drive signal must be generated and supplied to keep the system fed back. In fact, the contact breaker is also useful to generate the drive signal. The duty cycle adjusting facility is usually provided either in the form of a screw for varying the pressure on the breaker, or of a trimmer of the oscillation frequency.

Examples of such prior schemes are described in U.S. Pat. Nos. 5,293,149; 5,049,853; 5,457,437; 4,871,991; and 5,109,212.

It can be seen, from FIG. 1, which shows the current waveform through the trumpet inductor, that the current increases when the contact breaker is closed. The figure shows this increase as a sinusoidal arc (resonant effect) lasting over T/4 and less than T/2. Upon the contact breaker opening, the current falls gradually according to the inductor own law, down to its zero crossing. At this value, the current remains constant for a time period dependent on the duty-cycle setting by the contact breaker screw.

SUMMARY OF THE INVENTION

According to principles of the present invention, a method and a circuit for emulating a contact breaker for trumpets by means of an electronic circuit are provided which are self-trimming to the resonance frequency of the trumpet.

According to an embodiment of the invention an electronic circuit is provided which can operate as the contact breaker and use the value of the first derivative of the current supply to the inductor of the trumpet.

Of course, this electronic circuit may either be of the integrated type or the discrete component type.

The features and advantages of the method and circuit according to embodiments of the invention will be apparent from the following description given by way of non-limitative example with reference to the accompanying drawings.

BRIEF DESCRIPTION OF THE DRAWINGS

In the drawings:

FIG. 1 shows a diagram versus time of a current flowing through an inductor of a trumpet incorporating a contact breaker according to the prior art.

FIG. 2 shows schematically an electronic circuit for a trumpet according to an embodiment of the present invention.

DETAILED DESCRIPTION

Figure 3:
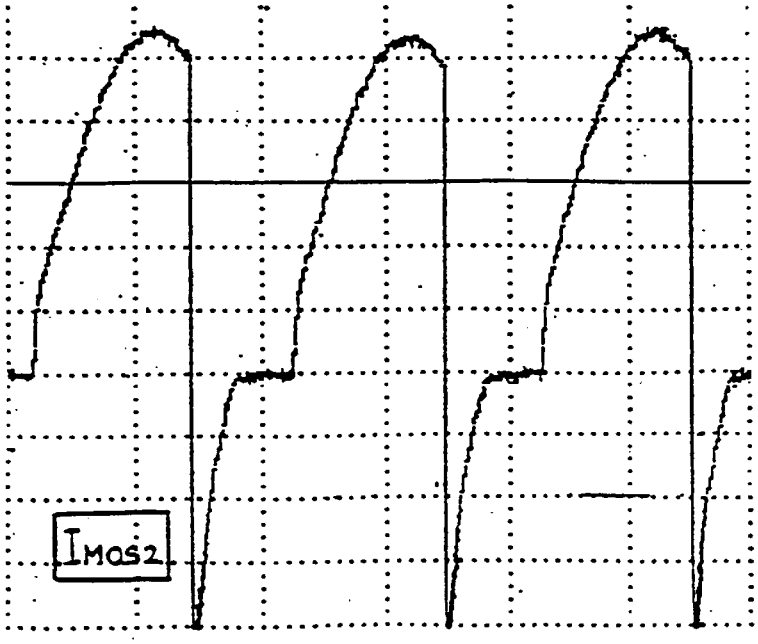
FIG. 3 shows the waveform of a current flowing through a sense component of the circuit according to the embodiment of the present invention.

While all commercial trumpets may look alike, each trumpet has a specific operating frequency, and the trumpets will describe sinusoidal arcs with different frequencies (e.g., ±5 Hz). Hence, the need for a self-oscillating system which can set the frequency for maximum acoustical efficiency.

Referring to the figures, and in particular to the example of FIG. 2, generally and schematically shown at 1 is an electronic circuit according to an embodiment of the present invention, intended as a substitute for the contact breaker which is customarily associated with a trumpet 2. Also associated with the electronic circuit 1 is a self-protected low-emission electronic device for driving the trumpet 2.

For convenience of illustration, the structure of a driver device 3 will be described first. The trumpet 2 is represented schematically in FIG. 2 by a loudspeaker symbol comprising an electromagnetic induction coil 15. The coil 15 comprises an inner core and an inductive winding having a first 4 and a second 5 terminal. The electronic circuit 1 according to the embodiment of the present invention is active to make and break an electrical connection between the coil 15 and a supply battery 6 according to the excitation state of the coil 15. The first terminal 4 of the winding is connected to the positive pole of the DC supply battery 6. Specifically, this terminal 4 is connected to the battery 6 through a first switch represented by a power transistor Pmos1 of the N-channel MOS type, whose operation will be explained further in this description.

Advantageously, the driver device 3 is connected between the battery 6 and the coil 15 of the trumpet 2. A smoothing capacitor C2 is placed in parallel with the battery supply 6. The driver device 3 comprises a first regenerative circuit portion 7 and a second protective circuit portion 8. The two portions, 7 and 8, are interconnected, but the second circuit portion 8 is optional in the sense that the second portion 8 could be missing and the device 1 still operate properly. The first circuit portion 7 comprises a resistive divider 11 formed of a pair of resistors R1 and R2 connected between the first terminal 4 of the coil 15 and the negative pole of the battery 6, which negative pole can be equated to a virtual ground.

Placed in parallel with the divider 11 is a power diode D3 which is forward biased from ground.

An interconnection node N is provided between the resistors R1 and R2 and has the control or gate terminal G1 of a second switch, represented by an NMOS power transistor VIP1, connected thereto. A Zener diode DZ1 is placed between the source SP1 and gate G1 terminals of the transistor VIP1, and connected in parallel with the resistor R2 in the divider 11. The transistor VIP1 has an intrinsic Zener diode across its drain DP1 and source SP1 terminals. Advantageously, the transistor VIP1 is of a type known as OMNIFET, manufactured by this Assignee, for conferring inherent thermal protection on the transistor against possible short circuits. The drain terminal DP1 of the transistor VIP1 is connected to the second terminal 5 of the coil 15. The second terminal 5 of the coil 15 is also coupled to the positive pole of the battery 6 through a power diode D2 which is forward biased from the terminal 5. The transistor Pmos1 has its source terminal SM1 connected to the first terminal 4 of the coil 15 and to the divider 11.

It should be noticed that the power components, represented by the diodes D2, D3 and the transistors VIP1, Pmos1, form a linking bridge structure wherein the power diodes are opposed to each other, and the power transistors are similarly opposed to each other. The transistor Pmos1 has its source SM1 and gate GM1 terminals interconnected by a resistor R5, and further has an intrinsic diode across its drain DM1 and source SM1 terminals. Taken to the gate terminal GM1 of the transistor Pmos1 is one end of the conduction path 10 formed of a series of a resistor R4 and a PNP bipolar transistor TR1. The bipolar transistor TR1 has a control terminal connected toward ground through a series of a resistor R6, the electronic circuit 1 and a user's pushbutton for operating the trumpet 2. A resistor R8 is provided between the base and emitter terminals of the transistor TR1. Furthermore, a diode D1 is connected between the emitter of the transistor TR1 and the drain terminal DP1 of the power transistor VIP1. The diode D1 is also connected to the second terminal 5 of the coil 15 and is forward biased from this terminal. The structure of the circuit portion 7 is completed by a capacitor C1 connected between the divider 11 and the diode D1. The capacitor C1 side connected to the diode D1 is also connected to the drain terminal DM1 of the transistor Pmos1 via a resistor R3. The diode D1 and capacitor C1 constitute a charge pump for the power transistor Pmos1 requiring for its operation a voltage signal which is boosted by approximately 10V above the supply level, which is of about 12V.

The circuit 1 may be optionally equipped with the second circuit portion 8, which portion is connected between the battery 6 and the first circuit portion 7, downstream of the circuit 1. This portion 8 comprises a power transistor Pmos2 of the N-channel MOS type connected between the negative pole of the battery 6 and the first circuit portion 7. Between the drain DM2 and source SM2 terminals of this transistor, there is an intrinsic diode; a Zener diode DZ2 is provided between the source SM2 and gate GM2 terminals of the transistor Pmos2 which diode is forward biased from the source terminal SM2. The circuit portion 8 is completed by a resistor R7 which is connected across the gate terminal GM2 and the positive pole of the battery 6. This circuit portion 8 provides protection from possible battery reversals, and once correctly polarized, admits current in either directions which is necessary for recovery of the inductive energy.

The structure of the electronic circuit 1 according to the embodiment of the present invention will now be described in detail. This circuit 1 comprises a first operational amplifier OP1 having a first non-inverting (+) input coupled toward ground through a resistor R12. The inverting (−) input of the amplifier OP1 is coupled to the source terminal SM2 of the transistor Pmos 2 in the circuit portion 8 through a series of a resistor R11 and a de-coupling capacitor C3. A resistor R14 feedback connects the output of the amplifier OP1 to the inverting (−) input thereof. The components R11, R14 and OP1 form essentially an inverting circuit. The output of the first amplifier OP1 is also coupled to the inverting (−) input of a second operational amplifier OP2 via a capacitor C4. The non-inverting (+) input of the second amplifier OP2 is connected to the corresponding non-inverting (+) input of the first amplifier OP1. Furthermore, the output of the second amplifier OP2 is fed back to the inverting (−) input of the same amplifier through a resistor R15. The components OP2, C4 and R15 form essentially a shunter/clipper circuit whose function will be explained hereinafter.

The output of the second amplifier OP2 is further connected to one side of a resistive divider 16 which comprises two resistors R9, R10 and has the other side connected to ground. The interconnect node of the resistors in the divider 16 is connected to the base terminal of an NPN bipolar transistor TR2 having its emitter connected to ground and its collector coupled to the base of the transistor TR1 in the portion 7, through the resistor R6. The second amplifier OP2 is powered from the positive pole of the battery 6 through a PNP bipolar transistor TR3 and the series of a diode D4 and resistor R16. This coupling is also powering the first amplifier OP1. The circuit node M branching off to the amplifier OP2 is coupled toward ground, through a Zener diode DZ3, and toward the non-inverting (+) input of the first amplifier OP1 through a resistor R13. This resistor R13 forms, in combination with the resistor R12, a resistive divider 17.

The control pushbutton 20 is coupled between the ground and the base terminal of the transistor TR3, through a resistor R17. A resistor R18 is connected between the base and the emitter of the transistor TR3.

Figure 4:
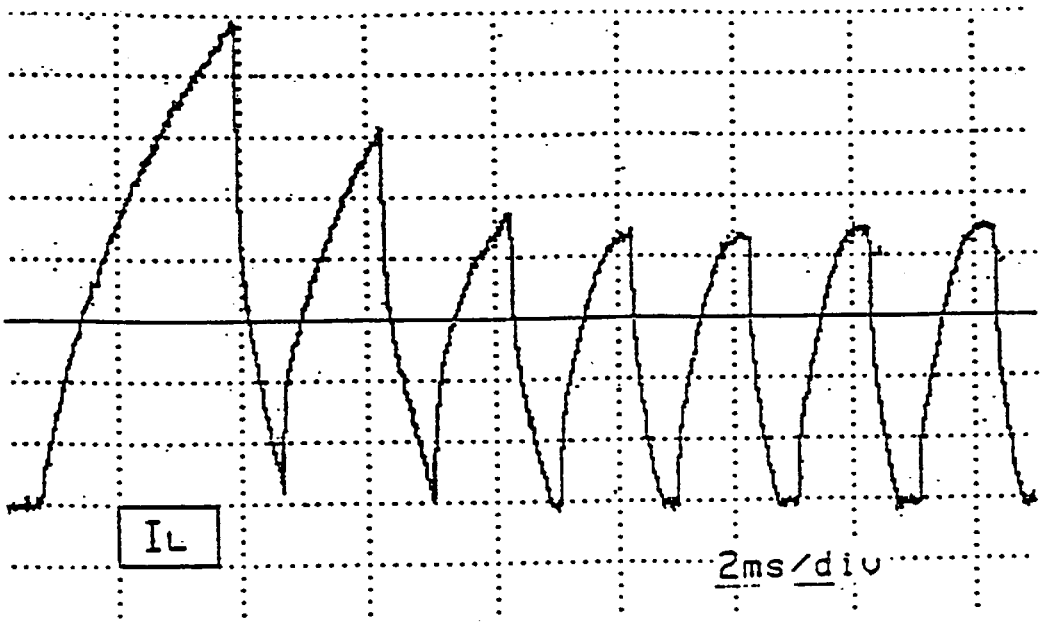
FIG. 4 shows the current waveform flowing through a trumpet incorporating the circuit according to the embodiment of the present invention.

With reference to the electric diagram of FIG. 2 and the waveforms of FIGS. 3 and 4, we will now describe how the method of this invention can be implemented. The transistor Pmos2 of the circuit portion 8, which is only operational in a "on" state thereof, is utilized as a sense resistor for sensing the waveform of the current being supplied to the inductor of the coil 15. Considering the current which flows through the transistor Pmos2 when the circuit portion 7 is driven by the circuit 1, the current is represented (FIG. 3) by a positive half-wave from the battery and a negative half-wave returned to the battery. It can be appreciated from the foregoing that the circuit 1 cuts off the current to the inductor as the current reaches the maximum value and begins to decrease. Thus, the idea behind the circuit 1 is to use the value of the "first derivative" of this current, as explained herein below.

The signal picked up from the source terminal SM2 through the decoupling capacitor C3 is applied to the inverting circuit comprising of the components R11, R14 and OP1. This inverting circuit amplifies the input signal thereto with a gain Av=−R14/R11. The resultant signal is input to the shunter/clipper circuit, that comprises the amplifier OP2, the capacitor C4 and the resistor R15, whose high value allows of the amplifier OP2 saturation and, hence, the clipping action. The divider 17, formed by the resistors R13-R12, supplies the intermediate potential to which the non-inverting inputs of the amplifiers OP1 and OP2 are referenced. The output from the second amplifier OP2 drives the transistor TR2 which, in turn, drives the transistor TR1 in the circuit portion 7. As a result, the power portion 7 is driven by the electronic circuit 1.

The pushbutton 20 activates, via the resistor R17, the transistor TR3 to power the two amplifiers OP1 and OP2 with the assistance of the components D4, R16 and DZ3 which function as a protection facility.

Referring now to the graph of FIG. 3, the positive half-wave of the current Imos2 flowing through the transistor Pmos2 will be discussed. At any time when the first derivative of this signal remains positive, the output of the saturated amplifier OP2 will be high, because the inverting (−) input of the amplifier OP1 is held at a lower potential than the non-inverting input, due to the capacitor C4 being in its discharge phase.

As the value of the derivative becomes negative, due to the capacitor C4 being in its charge phase, the potential at the inverting input of the amplifier OP2 will be raised above the potential at the non-inverting input, so that the output of OP2 will go to a low value and turn off the transistors Pmos1 and VIP1 in the circuit portion 7. During the current fall, the derivative will be taking markedly negative values, thereby confirming the "off" state of said transistors up to when the current Imos2 reaches its negative maximum.

During the last-mentioned phase, the potential at the inverting input will be much higher than that at the non-inverting (+) input of the amplifier OP2 in its saturation range. Accordingly, the next negative half-wave segment of Imos2, where the first derivative is positive, will force the amplifier OP2 to change over with a predetermined delay dependent on the saturation of OP2, which is itself a function of the resistance of R15, as well as of the amplification from the preceding stage. This results in the desired duty cycle and the start of a new cycle being obtained.

If required, a fine setting of the negative derivative value forcing the transistors Pmos1 and VIP1 to their "off" states can be achieved by having a resistor of MOhm size connected between the inverting input of the amplifier OP2 and ground.

It should not be overlooked that the transistor Pmos2 will present a sensing resistance RDSON which is a function of temperature. However, this will leave the control ability unhindered if the amplification from the first operational stage OP1 is held within certain limits, since it is the changes in the signal slope, and not its absolute values, that will be used for regulating purposes. For this same reason, the regulation will be affected not even by variations in the supply voltage. Of course, where no circuit block 8 is provided—which block is only useful as a protection from battery reversals—the transistor Pmos2 would be replaced with a simple sense resistor.

Upon the pushbutton 20 being depressed, the non-inverting (+) inputs of the amplifiers OP1 and OP2 will go to Vcc/2, while the inverting (−) input of the first amplifier OP1 is at a low potential because of C3 being discharged. Under such conditions, the output of OP1 goes to a high potential and begins to charge C4, holding the output of OP2 low until the potential at its inverting input drops to Vcc/2 due to C4 being charged, at which value the output of OP2 will go to a high potential.

Thus, a first current pulse is obtained which will maintain itself, in accordance with the previously explained principle of utilizing the positive derivative of the current signal.

Referring now to FIG. 4, it is worth remarking that the first current pulses, being of greater width and duration compared to the steady-state values, show no patterns whereby the derivative would reverse itself naturally. Therefore, the time constant $\tau$ of the first operational stage, where $\tau$=(R11+R13)C4, should be selected such that the input of the shunter circuit can always see a reversal of the derivative.

For the sake of completeness, the operation of the circuit portions 7 and 8 associated with the electronic circuit 1 will now be described briefly. The conduction path through the resistor R3, capacitor C1 and resistive divider 11 allows the capacitor C1 to be charged. A user wishing to sound the trumpet 2 depresses the pushbutton 20 which, once in the "closed" state, will allow the voltage across the capacitor C1 to be applied to the gate terminal GM1 of the transistor Pmos1 through the resistor R4. This causes the transistor Pmos1 to be turned on, and through the divider 11, the subsequent application of a sufficient gate voltage to turn on the transistor VIP1. A current begins to flow through the coil 15 and increases up to a predetermined value whereat the circuit 1 becomes activated. At this point, the voltage across the resistor R5 will turn off the transistor Pmos1, whose source terminal SM1 goes to a voltage value of −1V due to an inductive effect forced by the coil 15 and is held at about −1V by the diode D3. This also causes the transistor VIP1 to be turned off. The inductive current present in the circuit portion 7 is returned to the battery 6 through the diodes D2 and D3. With some of this current being devoted to charging the capacitor C1 through the diode D1, the device 1 is thus ready for a new working cycle. Consequently, some of the energy recovered is also used for driving the first power transistor Pmos1.

The first power transistor VIP1 has an intrinsic resistance equivalent to that of the second transistor Pmos2. Thus, in view of that both power devices are operated in series and dissipate the same amount of electric power, the thermal protection provided in the transistor VIP1 of the OMNIFET type will be extended automatically to the entire device. In addition, any thermal action concurrent with the capacitor C1 discharging, which in such a case wouldn't then receive any energy reintegration, would stop the oscillation until the pushbutton 20 is released. As for the second circuit portion 8, it should be noticed that, with a device according to the embodiment of the invention, it would be impossible to provide protection against battery reversals by merely introducing a diode in series with the power supply. Such an attempt would deny all recovery of the inductive energy. In a situation of correct polarity, the intrinsic diode of the transistor Pmos2 is forward biased and the MOS channel conducting. Accordingly, current is enabled to flow in either directions. On the other hand, if the battery 6 polarity is reversed, the intrinsic diode becomes reverse biased, and the channel of the transistor Pmos2 is turned off.

The method and circuit of this invention do solve the technical problem, and obtain a number of advantages, foremost among which is undoubtedly the fact that the construction of the trumpet can be made much simpler. Also, the added cost for the electronic portion is definitely less than that for the mechanical portion it is replacing.

Another advantage is that the calibration of the trumpet at the designing stage can eliminate the manual calibration step that each trumpet product had to undergo in the past. A further significant advantage of the circuit according to the embodiment of the invention surely is that it cuts down electromagnetic emissions. Furthermore, the inductive energy released from the electromagnetic coil can be fully recovered. Additional advantages are the thermal protection and protection from short circuits provided for the device as a whole by one of the power components incorporated thereto. This protection also includes avoidance of any shorting of the coil by limiting the maximum current that can flow through the devices connected to the coil.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A method for emulating a contact breaker in a trumpet comprising an inductor coil powered from a battery through a power driver device, the method comprising the steps of:

obtaining a derivative of a current value flowing through the inductor coil of a trumpet;

sensing a change in a slope of said derivative, and turning off a circuit portion of the driver device upon a negative slope being sensed; and turning said circuit portion back on after a transient period of a predetermined duration.

2. A method according to claim 1 wherein an electronic circuit is arranged to drive said circuit portion upon said negative derivative being sensed.

3. A method according to claim 2 wherein said electronic circuit is self-regulated for a resonant frequency of the trumpet.

4. A method according to claim 2, further comprising the step of cutting off the current supply to the inductor through said circuit portion after the current has reached a maximum value and begins to fall.

5. An electronic circuit for emulating a contact breaker in trumpets that include an inductor coil powered from a battery through a power driver device, the electronic circuit comprising:

a sense circuit portion adapted to sense a current value flowing through the inductor coil of a trumpet;

a shunter circuit for measuring a derivative of said current value, the shunter circuit having a comparator circuit associated therewith; and a control circuit adapted to control a circuit portion of the driver device upon a detection of a negative value of said derivative.

6. A circuit according to claim 5 wherein said shunter circuit comprises an operational amplifier being fed back to its inverting input and having an output connected to and adapted to control said control circuit.

7. A circuit according to claim 5 wherein said sense circuit portion comprises a transistor through which said inductor current flows.

8. A circuit according to claim 5 wherein said shunter circuit is powered from the positive pole of said battery through a series of protection components.

9. A circuit according to claim 5 wherein said sense circuit portion comprises an operational amplifier receiving, on one of its inputs, a voltage signal picked up from one terminal of a power transistor.

10. A self-protected low-emission electronic device for driving a trumpet comprising a coil powered from a battery through a user's control pushbutton, the device being included in an electrical connection between one terminal of the coil and said battery, and comprising a protection circuit portion connected between the battery and the trumpet and a bridge structure constructed of power components.

11. A method for operating a trumpet having an inductor and a driver circuit providing current to the inductor from a power source, the method comprising:

providing current to the inductor;

generating a current signal indicating the current provided to the inductor;

generating a derivative of the current signal;

terminating the current provided to the inductor when the derivative of the current signal is negative; and providing current to the inductor following a selected period of delay after the derivative of the current signal becomes positive.

12. The method of claim 11, further comprising:

sensing a first derivative of the current signal;

providing current from the inductor to the power source when the first derivative is negative;

sensing the first derivative when it is positive; and providing current to the inductor from the power source following the selected period of delay after the positive first derivative is sensed.

13. The method of claim 11, further comprising the step of regulating the driver circuit to a resonant frequency of the trumpet through circuitry in the driver circuit.

14. The method of claim 11, further comprising the steps of:

generating the current signal by directing current from the inductor to a sensing impedance;

inverting the current signal in an inverter circuit;

amplifying the inverted current signal in a clipper circuit and generating a control signal in the clipper circuit in response to the inverted current signal; and coupling the inductor to the power source through the driver circuit in response to the control signal.

15. The method of claim 14, further comprising the step of limiting the selected period of delay to a period of time in which an amplifier in the clipper circuit is saturated after the derivative of the current signal becomes positive.

16. A circuit for providing current to an inductive coil in a trumpet, the circuit comprising:

a power source;

a driver circuit coupled between the coil and the power source, the driver circuit being structured to couple the coil to the power source to provide current to the coil based on a control signal;

a sensing circuit coupled to receive current from the coil and being structured to generate a current signal indicating the current in the coil; and a control circuit coupled to receive the current signal and being structured to generate a derivative of the current signal and generate the control signal in response to the derivative of the current signal.

17. The circuit of claim 16 wherein the power source comprises a battery.

18. The circuit of claim 16 wherein the sensing circuit comprises an impedance coupled to receive current from the coil.

19. The circuit of claim 16 wherein the control circuit comprises:

an inverter circuit coupled to the sensing circuit to receive the current signal and being structured to invert the current signal; and a shunt circuit including an amplifier coupled to receive the inverted current signal, the shunt circuit being structured to generate the control signal in response to the inverted current signal.

20. The circuit of claim 19 wherein the control circuit is structured to generate the control signal to direct the driver circuit to couple the coil to receive current from the power source when the derivative of the current signal is positive and to couple the coil to provide current to the power source when the derivative of the current signal is negative.

* * * * *